US009599409B2

(12) United States Patent
Freund et al.

(10) Patent No.: US 9,599,409 B2
(45) Date of Patent: Mar. 21, 2017

(54) HEAT EXCHANGER FOR VEHICLE WITH TWO BLOCK DESIGN

(75) Inventors: Andreas Freund, Stuttgart (DE); Wolfgang Seewald, Stuttgart (DE); Michael Sickelmann, Kornwestheim (DE); Bernd Schäfer, Stuttgart (DE)

(73) Assignee: MAHLE INTERNATIONAL GMBH, Stuttgart (DE)

( * ) Notice: Subject to any disclaimer, the term of this patent is extended or adjusted under 35 U.S.C. 154(b) by 685 days.

(21) Appl. No.: 13/982,888

(22) PCT Filed: Feb. 6, 2012

(86) PCT No.: PCT/EP2012/051984

§ 371 (c)(1),
(2), (4) Date: Oct. 15, 2013

(87) PCT Pub. No.: WO2012/104438

PCT Pub. Date: Aug. 9, 2012

(65) Prior Publication Data

US 2014/0027096 A1 Jan. 30, 2014

(30) Foreign Application Priority Data

Feb. 4, 2011 (DE) ..... 10 2011 003 649

(51) Int. Cl.
*B60H 1/00* (2006.01)
*F28D 1/02* (2006.01)
(Continued)

(52) U.S. Cl.
CPC ..... *F28F 1/00* (2013.01); *F25B 39/028* (2013.01); *F28F 9/026* (2013.01); *F25B 2341/0662* (2013.01)

(58) Field of Classification Search
CPC .... F28F 1/00; F28F 9/026; F28F 9/027; F28F 9/0278; F25B 39/028; F25B 2341/0662
(Continued)

(56) References Cited

U.S. PATENT DOCUMENTS 4,524,823 A * 6/1985 Hummel ..... F25B 39/028 165/174
6,070,428 A * 6/2000 Higashiyama ..... F28D 1/0333 165/153
(Continued)

FOREIGN PATENT DOCUMENTS

DE 195 15 527 A1 10/1996
DE 197 19 257 A1 11/1998
(Continued)

OTHER PUBLICATIONS

International Search Report, PCT/EP2012/051984, Jan. 24, 2013, 3 pgs.
(Continued)

*Primary Examiner* — Len Tran
*Assistant Examiner* — Claire Rojohn, III
(74) *Attorney, Agent, or Firm* — Paul D. Strain, Esq.; Strain & Strain PLLC

(57) ABSTRACT

A heat exchanger, in particular for a heating or air-conditioning system in a motor vehicle, having an evaporator unit to which a refrigerant medium can be supplied via a distribution unit and through which said refrigerant medium flows and around which said refrigerant medium flows after only one diversion (two-block design) at the bottom in a diversion unit, wherein the distribution unit is designed to effect a uniform distribution of the refrigerant medium over the full width of the evaporator.

6 Claims, 3 Drawing Sheets

(51) Int. Cl.

| | |
|---|---|
| ***F28F 1/00*** | (2006.01) |
| ***F25B 39/02*** | (2006.01) |
| ***F28F 9/02*** | (2006.01) |

(58) Field of Classification Search
USPC ..... 165/41, 153, 158, 160
See application file for complete search history.

(56) References Cited

U.S. PATENT DOCUMENTS

| | | | | |
|---|---|---|---|---|
| 6,434,953 | B2 * | 8/2002 | Bimboes | 62/149 |
| 7,490,661 | B2 * | 2/2009 | Nishino | F25B 39/028 165/153 |
| 2001/0017202 | A1 * | 8/2001 | Mitsumoto | B01J 19/002 165/174 |
| 2008/0223566 | A1 * | 9/2008 | Higashiyama | F28D 1/05391 165/176 |
| 2009/0266528 | A1 * | 10/2009 | Saito | F25B 39/022 165/153 |
| 2010/0116474 | A1 * | 5/2010 | Kerler | F25B 39/022 165/148 |
| 2011/0146266 | A1 * | 6/2011 | Weinbrenner | F02B 29/0412 60/599 |
| 2011/0192584 | A1 * | 8/2011 | Ishizuka | F28D 1/05366 165/181 |

FOREIGN PATENT DOCUMENTS

| | | | |
|---|---|---|---|
| DE | 197 19 261 | A1 | 11/1998 |
| DE | 102 60 107 | A1 | 10/2003 |
| DE | 10 2004 018 282 | A1 | 11/2004 |
| DE | 10 2004 011 608 | A1 | 10/2005 |
| DE | 10 2007 035 581 | A1 | 3/2008 |
| DE | 10 2008 023 055 | A1 | 11/2008 |
| EP | 0 121 079 | A1 | 10/1984 |
| GB | 2 391 931 | A | 2/2004 |
| WO | WO 02/090860 | A1 | 11/2002 |
| WO | WO 2005/026641 | A1 | 3/2005 |

OTHER PUBLICATIONS

German Search Report, DE 10 2011 003 649.0, Sep. 14, 2011, 8 pgs.

* cited by examiner

HEAT EXCHANGER FOR VEHICLE WITH TWO BLOCK DESIGN

CROSS-REFERENCE TO RELATED PATENT APPLICATIONS

This application is a National Stage of International Application No. PCT/EP2012/051984, filed Feb. 6, 2012, which is based upon and claims the benefit of priority from prior German Patent Application No. 10 2011 003 649.0, filed Feb. 4, 2011, the entire contents of all of which are incorporated herein by reference in their entirety.

The invention relates to a heat exchanger according to patent claim 1.

Evaporators are known in which the two-phase refrigerant is distributed from an inflow duct to a through-flow device, preferably pipes, in particular flat pipes. After the vaporous refrigerant flows through the flat pipes it exits the evaporator via an outflow duct.

In this context, the uniform distribution of the liquid refrigerant in the entire length of the inflow duct causes problems. The reason for this is, inter alia, the formation of different forms of flow depending on the operating state. Furthermore, the demixture of the two-phase refrigerant mixture, which is homogeneous at the inlet of the evaporator, over the length of the inflow duct plays a particular role. Individual pipes are therefore supplied exclusively with refrigerant vapor, as a result of which the evaporator power is worsened.

In order to distribute the refrigerant in an optimum way to all the flat pipes, the refrigerant is distributed only over a small portion (typically ⅓, ¼ or ⅙) of the flat pipes and is diverted further in a plurality of blocks and in this way is directed through the evaporator. In these diversions, additional installations for uniformly mixing the liquid and gaseous phase are frequently provided. The actual provision of the refrigerant to only a portion of the block and existing installations leads here to a significantly increased pressure loss of the refrigerant in the entire block and/or the evaporation section.

In addition, in the heat exchanger which is disclosed in US 2008/0223566 A1 and embodied as a two block circuit, in particular for a heating or air conditioning system for motor vehicles, the refrigerant in the individual collectors is intermediately mixed by installations such as intermediate walls, orifices etc., With the result that greater pressure losses are to be expected in the evaporator unit. The ratio of the pressure differences in the distribution unit (injection pipe+distributor unit for the $1^{st}$ block) and the entire block (flat pipes+diversions between the blocks) is in the region of less than 3 here.

The heat exchangers which are of a two-block and also multi-block circuit design which are known from the prior art do, however, still leave something to be desired, in particular with regard to their structural design (complex fabrication process) and the comparatively high drop in the pressure of the refrigerant in the evaporation section.

The invention is based on the object of providing an improved heat exchanger which gives rise to small pressure losses in terms of the refrigerant, in particular in the heat-exchanging part of the evaporator, evaporation section and/or evaporator unit.

This object is achieved by means of a heat exchanger having the features of claim 1. Advantageous refinements are the subject matter of the dependent claims.

According to the invention, the heat exchanger, in particular for a heating or air-conditioning system in a motor vehicle, is designed having an evaporator unit to which a refrigerant medium can be supplied via a distribution unit and through which said refrigerant medium flows, and around which said refrigerant medium flows after only one diversion (two-block design) at the bottom in a diversion unit, wherein the distribution unit is designed to bring about uniform distribution of the refrigerant medium over the full width of the evaporator. Owing to the additional installations in the distributor unit, the two-phase refrigerant is therefore distributed uniformly among the flat pipes over the entire evaporator width and is diverted only once. A further advantage is the fact that owing to the uniform provision of the refrigerant to all the flat pipes intermediate mixing does not occur in the diversion. A configuration of the distribution unit with a ratio V of the pressure difference between the pressure difference in the distribution unit, on the one hand, and the pressure difference in the evaporator unit, on the other, can be provided which is larger than 3. An increase in the ratio of the pressure differences is necessary here for homogeneous distribution of the refrigerant in the distribution unit and therefore leads subsequently to an increase in the specific refrigerant power owing to a better temperature profile.

For example, the distribution unit can be configured with a ratio of the pressure difference between the pressure difference in the distribution unit, on the one hand, and the pressure difference in the evaporator unit, on the other, in the range between 3 and 70. These values have proven particularly advantageous within the scope of trials which have been carried out.

In this context, in particular a configuration of the distribution unit with a ratio of the pressure difference between the pressure difference in the distribution unit, on the one hand, and the pressure difference in the evaporator unit, on the other, can be provided which is in a range from 3 to 30 given a refrigerant medium mass flow of 30 kg/h, on the one hand, and from 30-70 in the case of a refrigerant medium mass flow of 250 kg/h.

Figure 1:
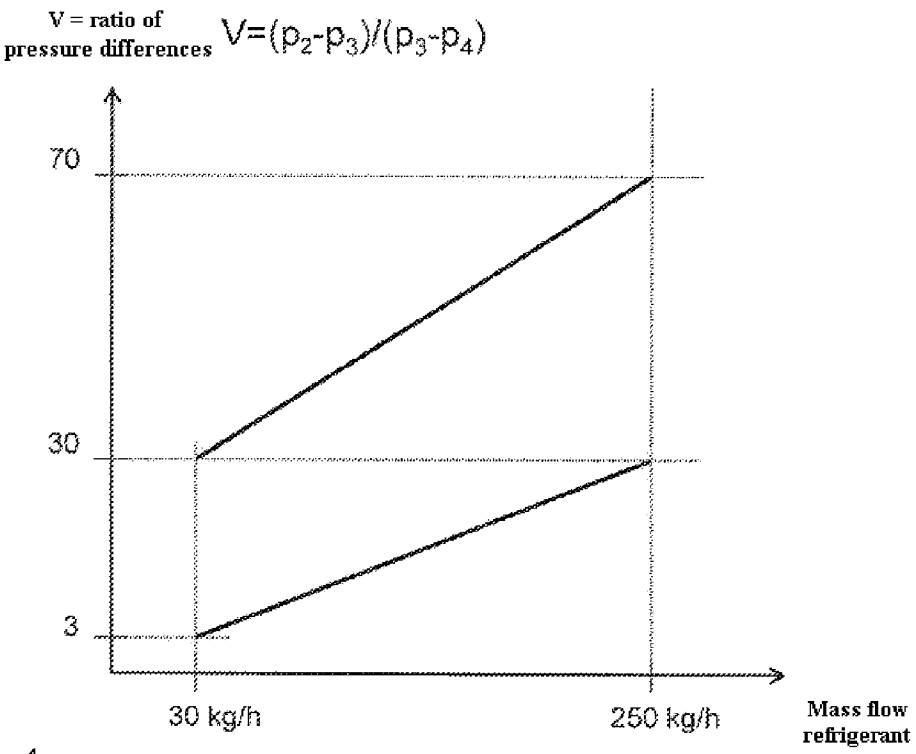
FIG. 1 illustrates the ratio of the pressure difference to the refrigerant medium mass flow in one embodiment of the application.
Figure 3:
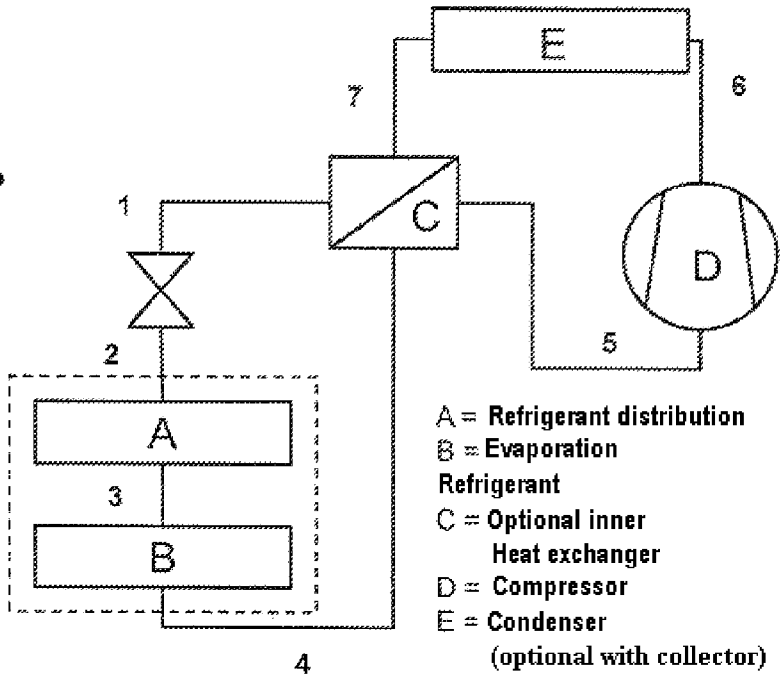
FIG. 3 illustrates a schematic view of a refrigerant circuit of one embodiment of the application.
Figure 2:
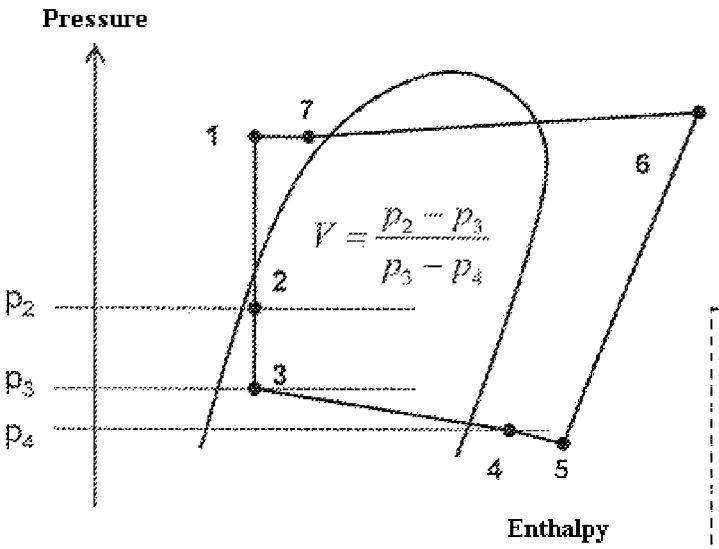
FIG. 2 illustrates a pressure enthalpy diagram of one embodiment of the application.

The ratio of the pressure differences to the refrigerant medium mass flow is, as described above, illustrated by FIG. 1. Here, the difference ($p_2$-$p_3$) represents the pressure difference in the distribution unit, and the difference ($p_3$-$p_4$) represents the pressure difference in the evaporator unit. For the sake of better illustration, FIGS. 2 and 3 respectively illustrate a pressure enthalpy diagram and a schematic view of a refrigerant circuit of an air-conditioning system, wherein significant points of the refrigerant circuit have been provided with numbers which have been correspondingly represented in the pressure enthalpy diagram.

Figure 4:
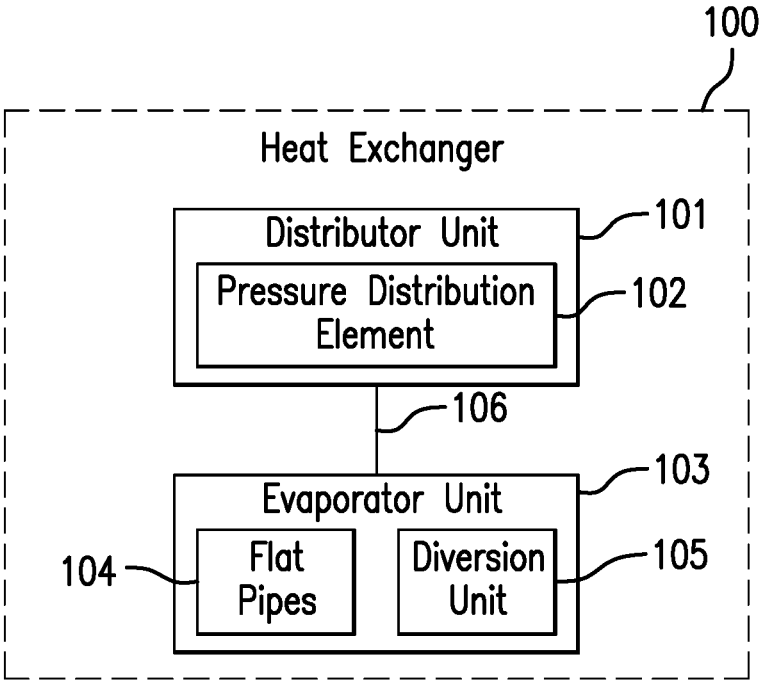
FIG. 4 shows a block diagram of an embodiment of the present application.

FIG. 4 shows a block diagram of an embodiment of the present application. A heat exchanger for a heating or air-conditioning system in a motor vehicle (100) includes a distributor unit (101) and an evaporator unit (103), which can optionally take the form of a dual flow evaporator. The distributor unit (101) optionally includes a pressure distribution element (102). The evaporator unit (103) optionally includes pipes (104), optionally flat pipes, and a diversion unit (105). A refrigerant medium (106) flows through the heat exchanger.

Owing to the distribution via the distribution unit with an additional pressure loss of the refrigerant, among all the flat pipes, specifically over the entire evaporator width, a uniform temperature profile can be achieved without additional installations in the system or in the collecting boxes.

An embodiment of the invention provides, in this context, in particular a diversion unit which is free of any intermediate mixing means.

A further embodiment provides a pressure distribution element in the distribution unit for distributing the refrigerant medium in parallel to all the pipes through which and around which said refrigerant medium flows, in particular flat pipes, of the evaporator unit.

For example, the installation of an additional pressure loss element at the evaporator inlet (before evaporation) for distributing the refrigerant in parallel among all the flat pipes over the entire width of the evaporator can also be provided as a pressure distribution element, with the result that all the flat pipes are supplied uniformly with liquid and gaseous refrigerant (this pressure loss element has no effect on the refrigerant power here). In this context, a large ratio of the pressure loss during the distribution of the refrigerant at the evaporator inlet with respect to the pressure loss in the evaporator system (evaporator section) is obtained.

The invention claimed is:

1. A heat exchanger for a heating or air-conditioning system in a motor vehicle comprising a distributor unit, an evaporator unit comprising a plurality of flat pipes, and a diversion unit, wherein the distributor unit, evaporator unit, and diversion unit are in fluid communication, wherein a refrigerant medium flows from the distributor unit into the evaporator unit, wherein the heat exchanger is of two-block design such that the diversion unit diverts the refrigerant medium only one time per pass through the heat exchanger, wherein the distributor uniformly distributes the refrigerant medium over the full width of the evaporator unit, wherein the evaporator unit comprises an evaporator inlet having a pressure loss element, wherein the difference in refrigerant pressure before entering and after exiting the distributor unit is represented by ($p_2$-$p_3$), wherein the difference in refrigerant pressure before entering and after exiting the evaporator unit is represented by ($p_3$-$p_4$), wherein a ratio (V) of these pressures is represented by the following equation:

$$V = \frac{(p_2 - p_3)}{(p_3 - p_4)}$$

wherein the value of the ratio (V) is greater than 3.

2. The heat exchanger according to claim 1, wherein the value of the ratio (V) is from 3 to 70.

3. The heat exchanger according to claim 2, wherein the value of the ratio (V) is from 3 to 30 when the refrigerant medium flows through the heat exchanger at a rate of about 30 kg/h, wherein the value of the ratio (V) is from 30 to 70 when the refrigerant medium flows through the heat exchanger at a rate of about 250 kg/h.

4. The heat exchanger according to claim 1, wherein the diversion unit includes no intermediate mixing means.

5. The heat exchanger according to claim 1, wherein a pressure distribution element in the distribution unit uniformly distributes the refrigerant medium in parallel to all of the plurality of flat pipes of the evaporator unit.

6. The heat exchanger according to claim 1, wherein the evaporator unit is arranged as a dual-flow evaporator.

* * * * *